US006179668B1

(12) United States Patent
Kan

(10) Patent No.: US 6,179,668 B1
(45) Date of Patent: Jan. 30, 2001

(54) ELECTRIC CONNECTOR INCLUDING A CIRCUIT BOARD

(76) Inventor: Chin-Mao Kan, No. 2-1, Chung Fu Rd., Sec. 2, Chung Li City (TW)

( * ) Notice: Under 35 U.S.C. 154(b), the term of this patent shall be extended for 0 days.

(21) Appl. No.: 09/337,526

(22) Filed: Jun. 22, 1999

(51) Int. Cl.[7] ..... H01R 33/20
(52) U.S. Cl. ..... 439/676; 439/620
(58) Field of Search ..... 439/76.1, 676, 439/620, 629–632, 941

(56) References Cited

U.S. PATENT DOCUMENTS 5,647,767 * 7/1997 Scheer et al. ..... 439/620
5,759,067 * 6/1998 Scheer ..... 439/607

* cited by examiner

*Primary Examiner*—Brian Sircus
*Assistant Examiner*—Son V. Nguyen
(74) *Attorney, Agent, or Firm*—Dougherty & Troxell

(57) ABSTRACT

An electric connector includes a terminal board and a circuit board housed in a plastic body for connecting an electric power to an electric device. The terminal board has a plurality of upper terminals and lower terminals integrally formed therein. The upper terminals have curved contacts extending into a cavity formed in a vertical section of the terminal board. The lower section forms two rows of curved contacts at one end extending into the cavity. The curved contacts of the terminals may engage with the circuit board securely in the terminal board. While the terminal board may establish electric connection required, the circuit board may change input current and signals to provide additional function, improved performance filtering, cross talk prevention, and the like to increase added value of the connector.

1 Claim, 4 Drawing Sheets

ELECTRIC CONNECTOR INCLUDING A CIRCUIT BOARD

BACKGROUND OF THE INVENTION

1. Filed of the Invention

This invention relates to an electric connector and particularly to an electric connector that includes a circuit board for connecting electricity and providing change or process function on input signals to produce other function such as rectification, improved throughput, and cross talk prevention.

2. Description of the Prior Art

Electric connectors are widely used in household appliances, information products, communication devices and the like for establishing electric connection between input current and output current. A conventional connector usually has a terminal with one end for input and another end for output to connect an electric power source with an electric device. However rapid technology innovation in telecommunication products and compact size requirements have created new demands for the connector, such as to include additional function (e.g., rectification, cross talk prevention), adding various type of electronic components (e.g., capacitor, resistor, etc.) to enhance its function etc.

SUMMARY OF THE INVENTION

In view of aforesaid the issues, it is therefore an object of this invention to provide an electric connector which includes a circuit board so that in addition to connecting electricity from a power source to an electric device, the connector may offer other desired functions such as rectification, prevention and the like. It thus becomes more versatile and has greater added value.

According to one aspect of this invention, the connector includes a body a substantially L-shaped terminal board with a cavity for including input and output terminals located therein and a circuit board engageable with the cavity for coupling with the input and output terminals. Hence besides establishing electricity connection like a conventional connector, the circuit board may provide a wide variety of desired functions and making the connector more useful and valuable.

DETAILED DESCRIPTION OF THE PREFERRED EMBODIMENTS

Figure 1:
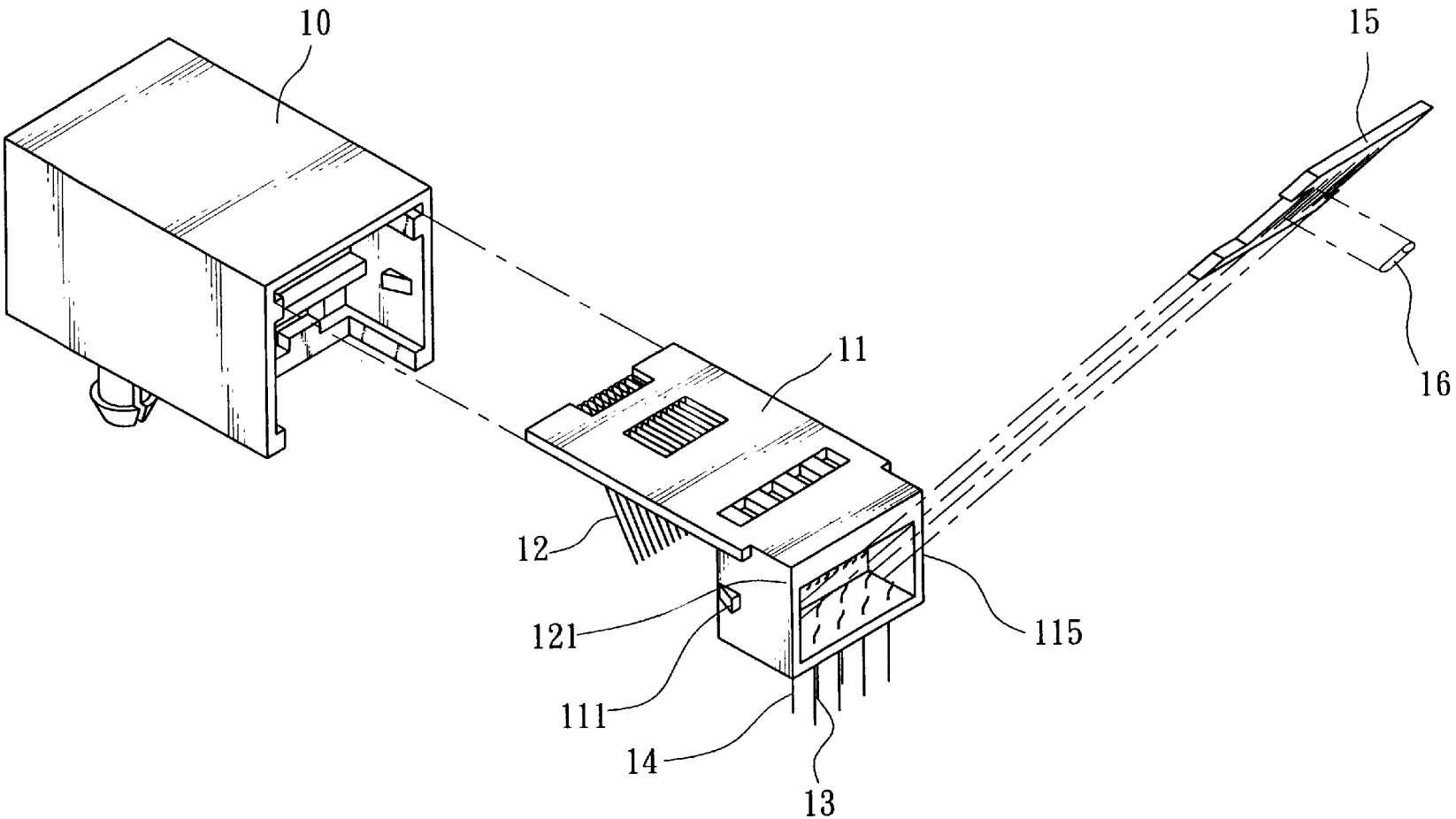
FIG. 1 is a perspective exploded view of this invention.
Figure 2:
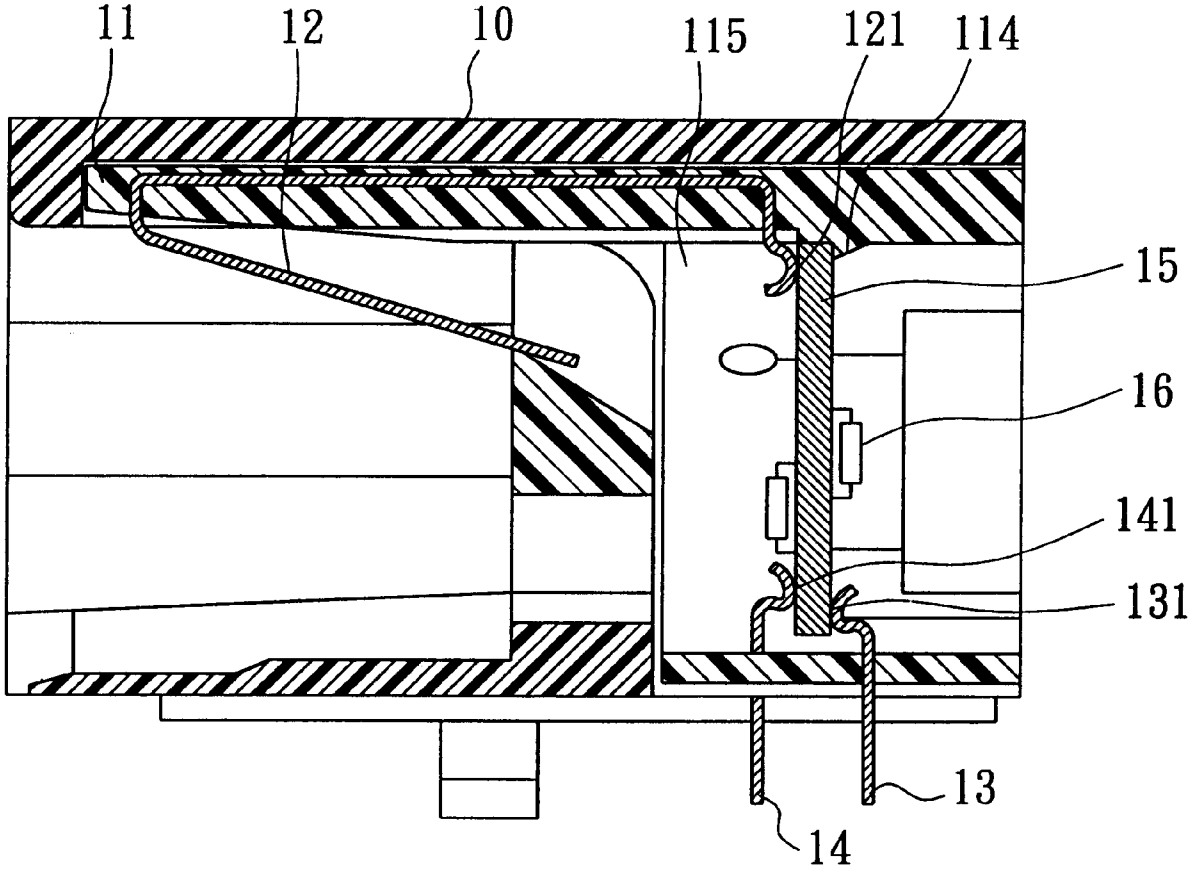
FIG. 2 is a front sectional view of this invention.
Figure 3A:
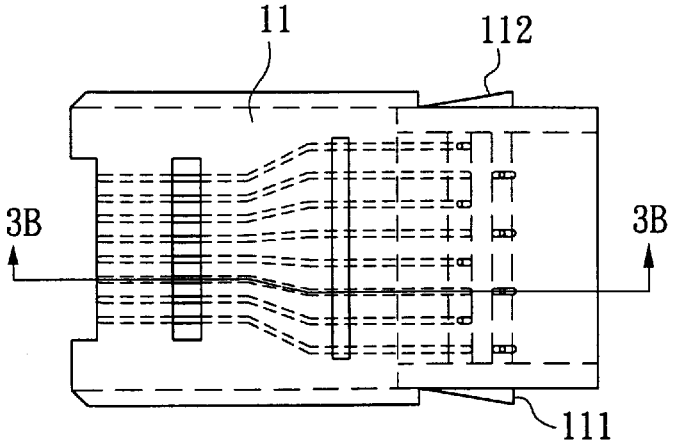
FIG. 3A is a top view of the terminal board.
Figure 3B:
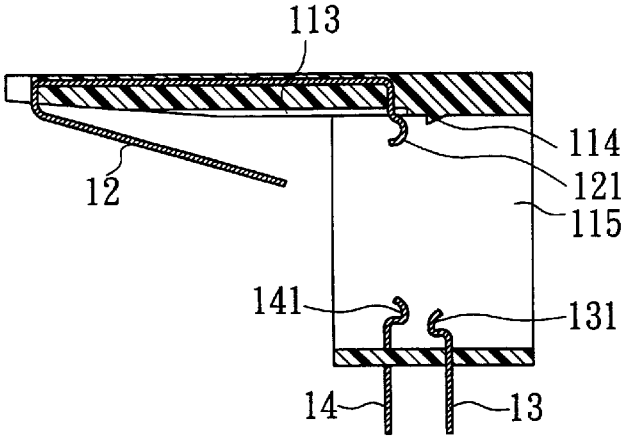
FIG. 3B is a cross-sectional view taken along line 3B—3B in FIG. 3A.
Figure 3C:
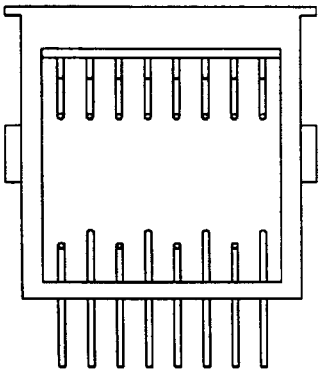
FIG. 3C is an end view of the terminal of FIG. 3A.

Referring to FIGS. 1 and 2, the electric connector according to this invention includes a body 10, a terminal board 11 which include terminals 12, 13 and 14 located therein and a circuit board 15 engageable with the terminal board 11. The body 10 is made of plastics and is engageable with the terminal board 11 for receiving input electricity and output to an electric device such as a computer or telephone. The terminal board 11 is a substantially L-shaped member integrally made by means of injection molding process with the terminals 12, 13 and 14.

The terminal board 11 has a cantilever type top flange and a vertical section with a cavity 115 formed therein. The terminal 12 is the upper one and has a middle section embedded in the top flange. It further has one bent contact end 121 extended vertically in the cavity 115 for engaging with the circuit board 15 (also referring to FIG. 5). Another end of the terminal 12 is slanted and suspended below the top flange for connecting with an input power source. There is a groove 113 formed in a bottom side of the top flange under each terminal 12 to enable the terminal 12 to have more elastic strength for engaging with the circuit board and input power. There is a latch nose 114 formed under a top wall of the cavity 115 spaced from the bent contact end 121 for sandwiching one end of the circuit board 15 securely therein (also referring to FIG. 2). The lower terminals 13 and 14 are arranged in two rows through a bottom wall of the cavity 115 and have respectively bent lower contacts 131 and 141 extending the cavity 115 for engaging with the circuit board 15. At two lateral sides of the terminal board 11, there are provided respectively a latch ear 111 engageable with a mating ear located in an inside wall of the body 10.

Figure 4B:
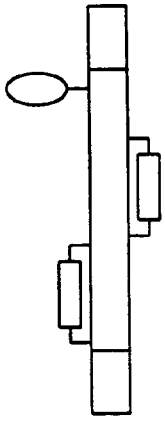
FIG. 4B is an end view of the circuit board of FIG. 4A.
Figure 4A:
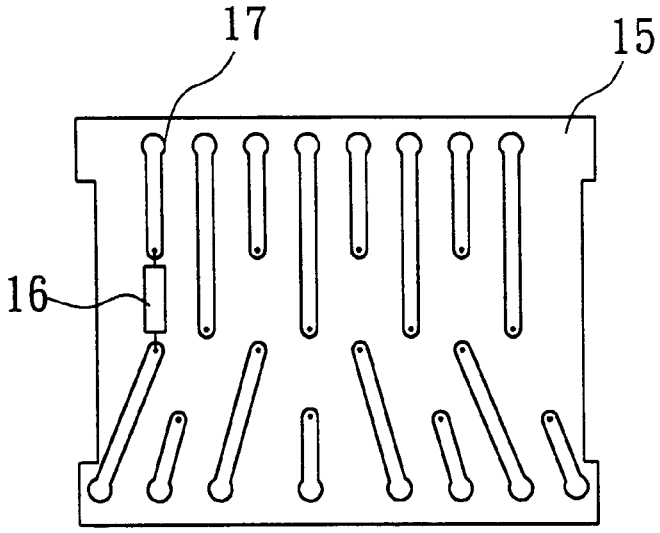
FIG. 4A is a side view of the circuit board for this invention.

Referring to FIGS. 4A and 4B the circuit board 15 has a plurality of electric traces 17 formed therein which couples with a plurality of electric components 16 such as capacitor, resistor, inductor.

Figure 5:
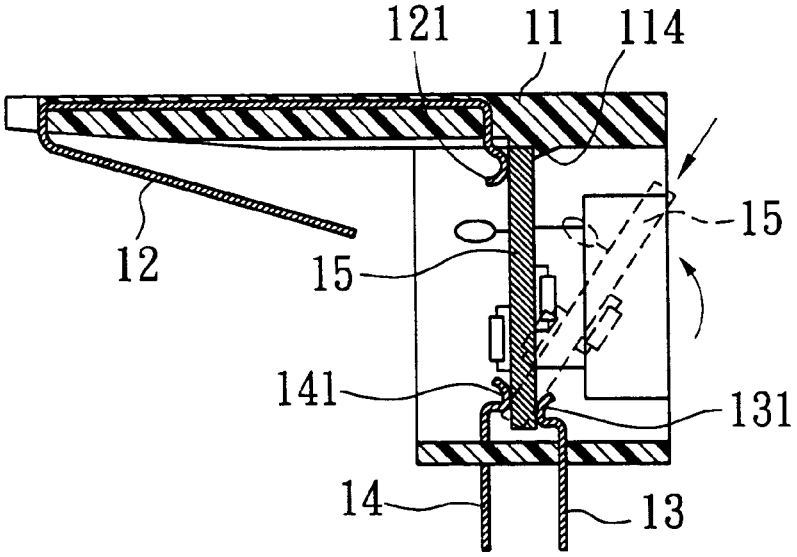
FIG. 5 is a sectional view of an assembly of a terminal board and a circuit board.

Referring to FIG. 5, when in use, placing the bottom edge of the preset circuit board 15 between the lower contacts 131 and 141, then the top edge of the preset circuit board 15 is pushed toward the upper terminal contact end 121. When the top edge passes through the latch nose 114 by force, it is wedged between the contact end 121 and the latch nose 114 tightly while the bottom edge is clamped securely between the lower contacts 131 and 141. Thus the circuit board 15 is securely engaged with the terminal board 11 to become an assembly. Then the terminal board 11 and the circuit board 15 assembly may be inserted into the body 10 to form a completed connector (as shown in FIG. 2).

Through the terminal board 11, the connector of this invention may offer electric connection like a conventional one. Through the preset circuit board 15, this connector may further provide additional functions not available in a conventional connector such as rectification, to augment or change electric current or to make other use, to prevent cross talk, to increase performance.

What is claimed is:

1. An electric connector comprising:

a) a body having a first cavity therein;

b) a terminal board located in the first cavity, the terminal board having a substantially L-shaped configuration including a cantilever top flange extending from a base section, the base section having a second cavity therein and a latch nose extending into the second cavity;

c) a plurality of first terminals mounted in the top flange, the first terminals having first ends slantedly extending into the first cavity, and second ends extending into the second cavity adjacent to and spaced from the latch nose;

d) a plurality of second terminals in the base section having first ends extending exteriorly of the base section and second ends extending into the second cavity arrayed in two spaced apart rows; and, e) a circuit board having first and second opposite edges mounted in the second cavity such that a first edge is clamped between the latch nose and the second ends of the first terminals, and the second edge is clamped by the spaced apart rows of the second ends of the second terminals.

* * * * *